US011197556B1

(12) United States Patent
Hung

(10) Patent No.: US 11,197,556 B1
(45) Date of Patent: Dec. 14, 2021

(54) COMBINATION MATTRESS

(71) Applicant: Shang Kuang Pao Co., Ltd., Taipei (TW)

(72) Inventor: Kun-Yu Hung, Taipei (TW)

(73) Assignee: SHANG KUANG PAO CO., LTD., Taipei (TW)

( * ) Notice: Subject to any disclaimer, the term of this patent is extended or adjusted under 35 U.S.C. 154(b) by 0 days.

(21) Appl. No.: 16/990,986

(22) Filed: Aug. 11, 2020

(51) Int. Cl.

| | |
|---|---|
| ***A47C 27/05*** | (2006.01) |
| ***A47C 27/14*** | (2006.01) |
| ***A47C 23/043*** | (2006.01) |
| ***A47C 27/00*** | (2006.01) |
| ***A47C 21/02*** | (2006.01) |

(52) U.S. Cl.
CPC ..... *A47C 23/043* (2013.01); *A47C 21/022* (2013.01); *A47C 27/005* (2013.01)

(58) Field of Classification Search
CPC ..... A47C 27/05; A47C 27/053; A47C 27/056; A47C 27/14; A47C 27/142; A47C 27/144; A47C 23/002; A47C 27/002; A47C 31/105; A47C 21/046
See application file for complete search history.

(56) References Cited

U.S. PATENT DOCUMENTS 2,279,886 A * 4/1942 Fuchs ..... A47C 27/007 5/699
2,400,731 A * 5/1946 Armstrong ..... A47C 31/105 5/500
2,870,824 A * 1/1959 Le Barre ..... A47C 31/105 5/482
3,493,980 A * 2/1970 Haller ..... A47C 27/05 5/716
5,065,485 A * 11/1991 Zocco ..... A47C 31/105 29/91.1
5,966,759 A * 10/1999 Sanders ..... A47C 27/007 5/497
6,363,553 B1 * 4/2002 Baumgartel ..... A47C 31/007 5/482
6,651,278 B2 * 11/2003 Ghanem ..... A47G 9/02 5/484
6,823,543 B2 * 11/2004 Diak/Ghanem ..... A47G 9/02 5/425
6,859,962 B2 * 3/2005 Diak/Ghanem ..... A47G 9/02 5/484

(Continued)

*Primary Examiner* — Peter M. Cuomo
*Assistant Examiner* — Ifeolu A Adeboyejo
(74) *Attorney, Agent, or Firm* — Leong C. Lei

(57) ABSTRACT

A combination mattress includes an elastic body, a bottom cover, longitudinal side covers, transverse side covers, and a pad body, where the bottom cover, longitudinal side covers and transverse covers are in sheet shape, the periphery of each of which is configured with a connecting element; the bottom periphery of the pad body is configured with a connecting element, and the upper edge thereof a shielding sheet. Upon assembly, the bottom cover, two longitudinal side covers and two transverse side covers are covered on the elastic element, and the pad body is placed on the elastic body to form a mattress. The detachable longitudinal side covers and transverse side covers are used to make the mattress have air permeability in different directions, and the detachable pad body allows the replacement thereof with a different type of pad body, thereby improving the practical value of the mattress.

5 Claims, 9 Drawing Sheets

(56) References Cited

U.S. PATENT DOCUMENTS

| | | | | |
|---|---|---|---|---|
| 9,814,324 | B2 * | 11/2017 | Scarleski | A47C 31/105 |
| 9,962,008 | B1 * | 5/2018 | Omiste | A47C 27/144 |
| 2003/0093864 | A1 * | 5/2003 | Visser | A47C 27/056 5/720 |
| 2004/0003471 | A1 * | 1/2004 | VanSteenburg | A47C 27/081 5/709 |
| 2004/0148706 | A1 * | 8/2004 | Visser | A47C 27/056 5/720 |
| 2009/0100606 | A1 * | 4/2009 | An | A47C 27/064 5/716 |
| 2014/0068868 | A1 * | 3/2014 | Morzano | A47G 9/00 5/691 |
| 2015/0182031 | A1 * | 7/2015 | Jensen | A47C 21/00 5/690 |
| 2016/0100697 | A1 * | 4/2016 | Prochazka | A47C 31/123 5/669 |
| 2018/0027986 | A1 * | 2/2018 | Schulte | A47C 27/085 |
| 2019/0133334 | A1 * | 5/2019 | Kho | A47C 27/045 |
| 2019/0313809 | A1 * | 10/2019 | Dolter | A47C 31/105 |
| 2020/0260881 | A1 * | 8/2020 | Deragon | A47C 27/15 |

* cited by examiner

COMBINATION MATTRESS

(a) TECHNICAL FIELD OF THE INVENTION

The present invention relates to a combination mattress, and more particularly to a combination mattress that can have different directions of ventilation effects according to needs, and can be replaced with different types of pad bodies to improve practical value.

(b) DESCRIPTION OF THE PRIOR ART

We spend about one-third of our daily time sitting or lying in bed to rest, such that mattresses are quite indispensable items in current life. Therefore, the designs of mattresses can quite directly affect the quality of sleep; a good bed is enough to affect the quality of rest and sleep, and it will thus directly affect your health, so people's requirements for mattresses are also the needs and trends of modern society.

The general structure of a spring mattress is to provide pads on the top and bottom sides of the spring layer, and a cover is wrapped around the spring layer and the outsides of the pads, with the joint being fixed by sewing. That is to say, traditional spring mattresses are combined together into one body, which is unable to replace the mattress arbitrarily (for example, a general mattress is originally purchased, and a new one must be purchased and the original one must be thrown away if you want to sleep on a straw mat or latex bed, increasing economic burden and not in line with environmental protection), and even if some mattresses have a double-sided design (such as cloth and straw mat), there only two options. In addition, in hotter summer, there is no way to make the mattress cooler with a simple disposal, or in a colder winter, you can only lay an electric blanket and other thermal insulation on the mattress, and sleep directly on the electric blanket, seeming to be a certain degree of danger, which is the defects of the current mattress.

SUMMARY OF THE INVENTION

To overcome the above defects, to design a combination mattress, allowing the mattress to be breathable, and to make the mattress replaceable with different types of pad bodies to increase its practical value, the present invention is proposed.

The main object of the present invention is to provide a combination mattress, allowing the mattress to form different directions of ventilation effects when the temperature is high in summer, and allowing the replacement of different types of pad bodies according to your preference to improve the practical value of the mattress through the separable combination.

The above combination mattress includes an elastic body, a bottom cover, longitudinal side covers, transverse side covers, and a pad body, where the bottom cover, longitudinal side covers and transverse covers are in sheet shape, the periphery of each of which is configured with a connecting element; the bottom periphery of the pad body is configured with a connecting element, and the upper edge thereof a shielding sheet. Upon assembly, the bottom cover, two longitudinal side covers and two transverse side covers are covered on the elastic element, and the pad body is placed on the elastic body to form a mattress. The detachable longitudinal side covers and transverse side covers are used to make the mattress have air permeability in different directions, and the detachable pad body allows the replacement thereof with a different type of pad body such as a straw mat, latex or water bed, waterproof pad, or coconut fiber bed, thereby improving the practical value of the mattress.

According to the above combination mattress, the connecting elements configured on the bottom cover, two longitudinal side covers, two transverse side covers and pad body are zippers or corresponding Velcro tapes.

According to the above combination mattress, the bottom cover is provided with a plurality of first positioning elements arranged at intervals, and a bottom periphery of the pad body a plurality of second positioning elements corresponding to the first positioning elements; whereby, when the longitudinal side cover, transverse side cover are detached down and separated, the first positioning elements and second positioning elements are used to combine with each other to allow the pad body and elastic body to be kept in position to prevent displacement.

According to the above combination mattress, the first positioning element is a flexible belt, an end thereof is configured with a hook, and the second positioning element is a retaining ring corresponding to the hook.

According to the above combination mattress, the first positioning element and second positioning element are corresponding Velcro tapes.

According to the above combination mattress, the elastic body may be gold-plated, silver-plated, copper-plated, nickel-plated or zinc-plated, or sprayed or baked in yellow, blue, red, green or other different color.

DETAILED DESCRIPTION OF THE PREFERRED EMBODIMENTS

Figure 1:
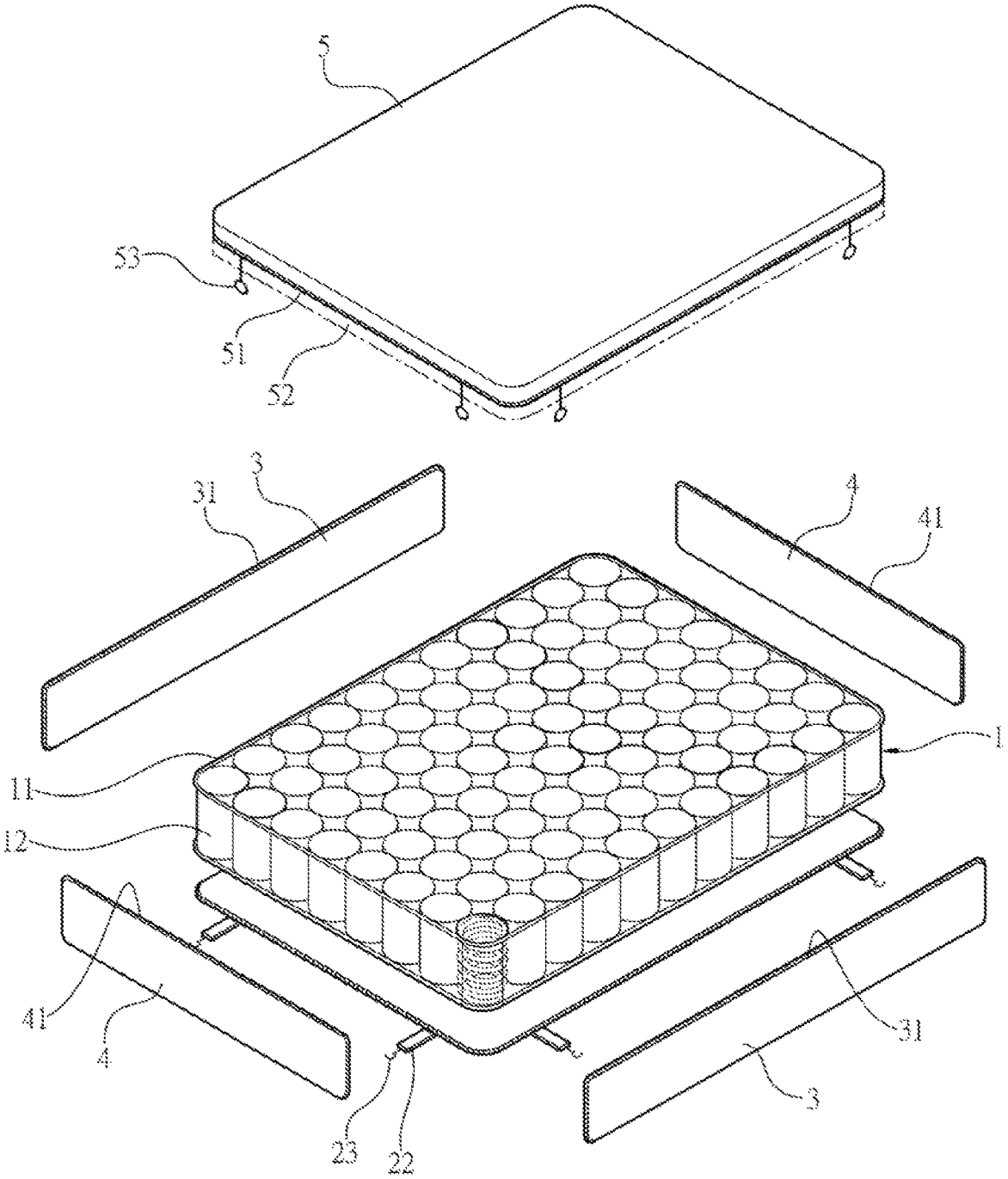
FIG. 1 is an exploded view of the present invention.
Figure 1A:
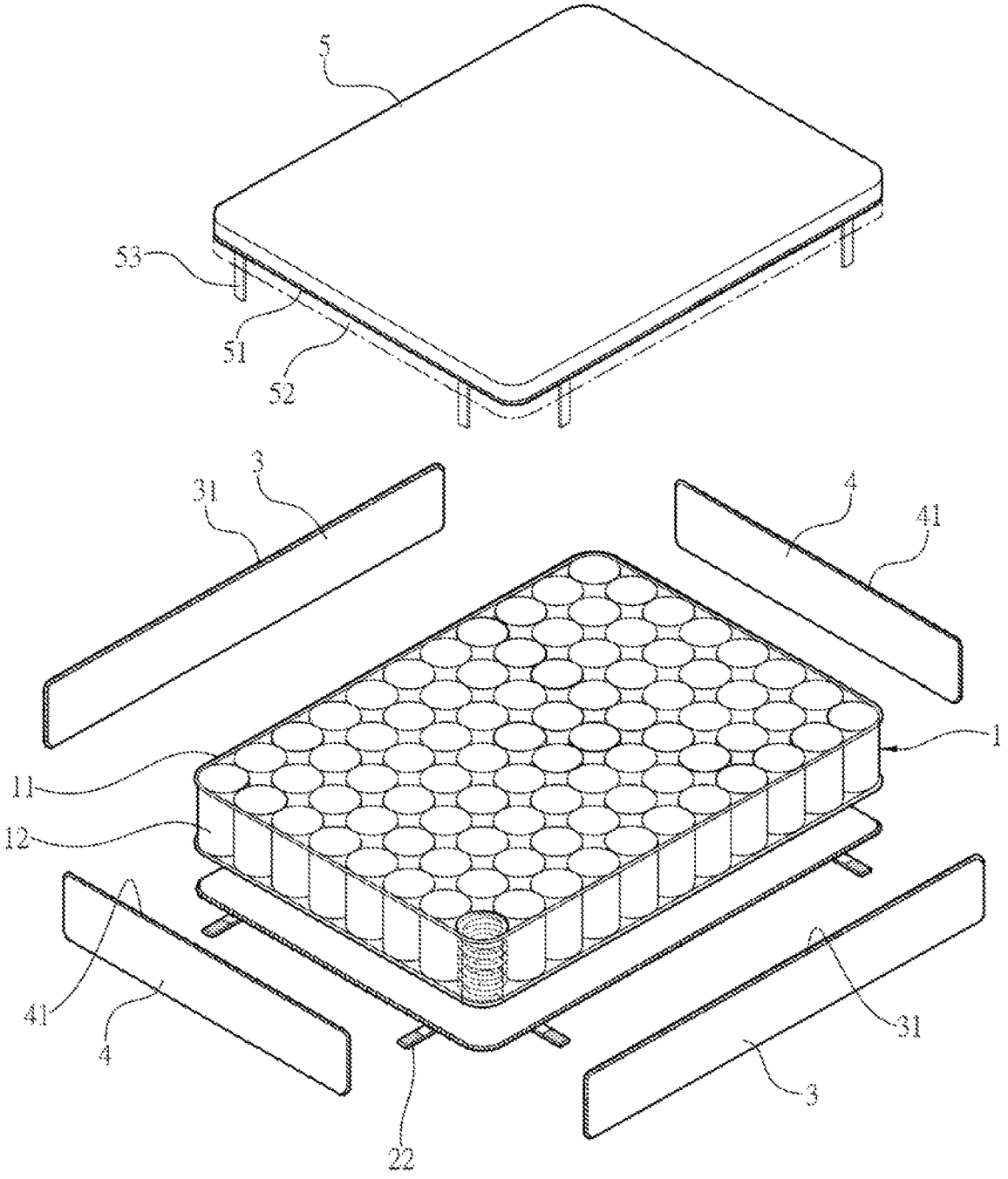
FIG. 1A is an exploded view of another preferred embodiment of the present invention.
Figure 2:
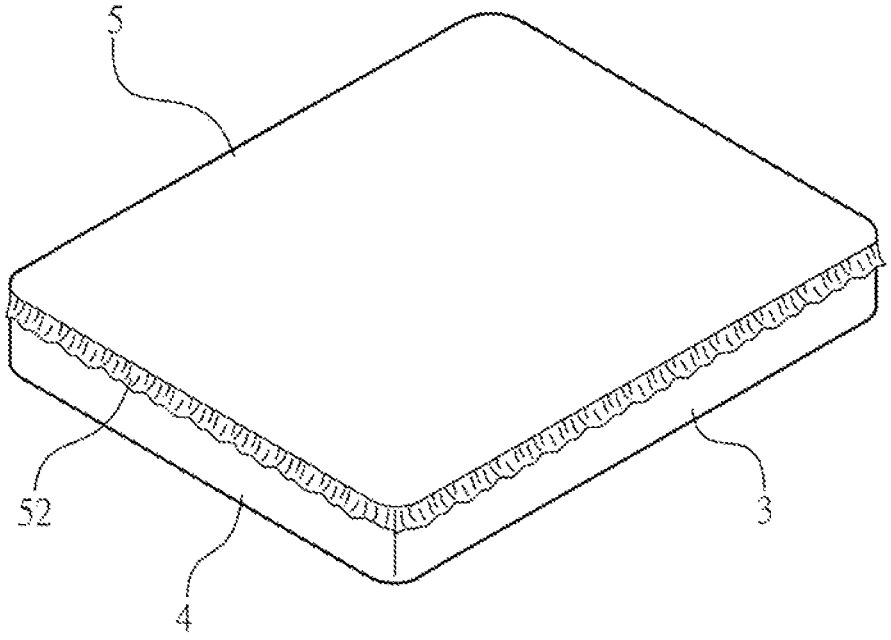
FIG. 2 is a perspective view of the present invention.

Referring to FIGS. 1, 1A and 2, a combination mattress of the present invention includes an elastic body 1, a bottom cover 2, two longitudinal side covers 3, two transverse side covers 4, and a pad body 5, where the elastic body 1 includes a frame 11 and a plurality of cylindrical coils 12 configured side by side in an array inside the frame 11; the bottom cover 2 is a sheet, on the periphery of which is configured with a connecting element 21 and a plurality of first positioning elements arranged at appropriate intervals. In a preferred embodiment, the elastic body 1 may be gold-plated, silver-plated, copper-plated, nickel-plated or zinc-plated, or sprayed or baked in yellow, blue, red, green or other different color; the connecting element 21 configured on the periphery of the bottom cover 2 is a zipper, or Velcro; the first positioning element 22 is a flexible belt, the end of which is configured with a hook or a Velcro as shown in FIG. 1A.

Each of the two longitudinal covers 3 is a sheet, the periphery of which is configured with a connecting element 31. In the embodiment, the connecting element 31 configured on the periphery is a zipper or Velcro.

Each of the two transverse side covers 4 is a sheet, on the periphery of which is configured with a connecting element 41. In the embodiment, the connecting element 41 configured on the periphery is a zipper or Velcro.

The pad body 5 is a straw mat, latex, water bed, waterproof pad or other different type of pad body, on the bottom periphery of which is configured with a connecting element 51, and on the upper edge of which is provided with a shielding sheet 52. In the embodiment, the connecting element 51 configured on the periphery is a zipper or Velcro, and the shielding sheet 52 is extended downward from the upper edge to a position lower than the connecting element 51; the shielding sheet 52 may be a lace, or the like. Furthermore, the bottom periphery of the pad body 5 is provided with a plurality of second positioning elements 53 arranged at intervals and corresponding to the first positioning elements 22 of the bottom cover 2. In the embodiment, the second positioning element 53 may be a retaining ring corresponding the hook 23 of the first positioning element 22, or the first positioning element 22 and corresponding second positioning element 53 may be Velcro tapes as FIG. 1A shows.

With the combination of the above components, a combination mattress can be formed. Upon combination, the bottom cover 2, two longitudinal side covers 3 and two transverse side covers 4 are connected by the connecting elements 21, 31, 41 to form a cover body for covering the elastic body. Thereafter, the pad body 5 is placed on the elastic body 1, and the assembly of a mattress is completed by connecting the connecting element 51 of the pad body 5 with the connecting elements 31, 41 of the two longitudinal side covers 31 and two transverse side covers 4. Whereby, when used, the detachable two longitudinal side covers 3 and two transverse side covers 4 can be used to make the mattress have air permeability in different directions, and the detachable pad body 5 allows the replacement of it with a different type of pad body such as a straw mat, latex, water bed, waterproof pad, or coconut fiber bed, thereby improving the practical value of the mattress.

Figure 3:
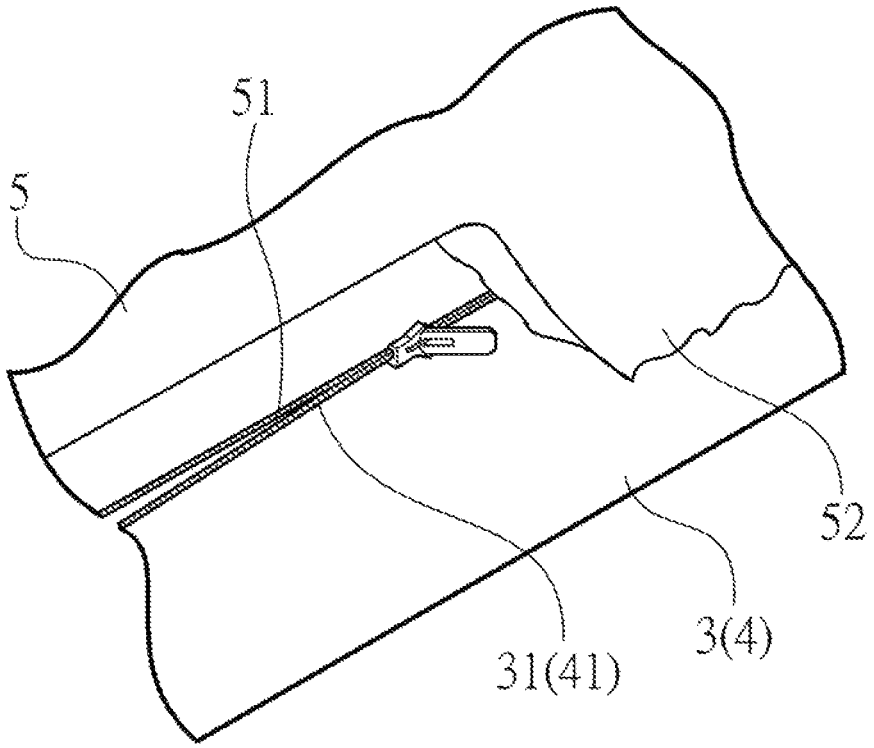
FIG. 3 is a perspective view of a pad body connecting element and shielding sheet of the present invention.
Figure 4:
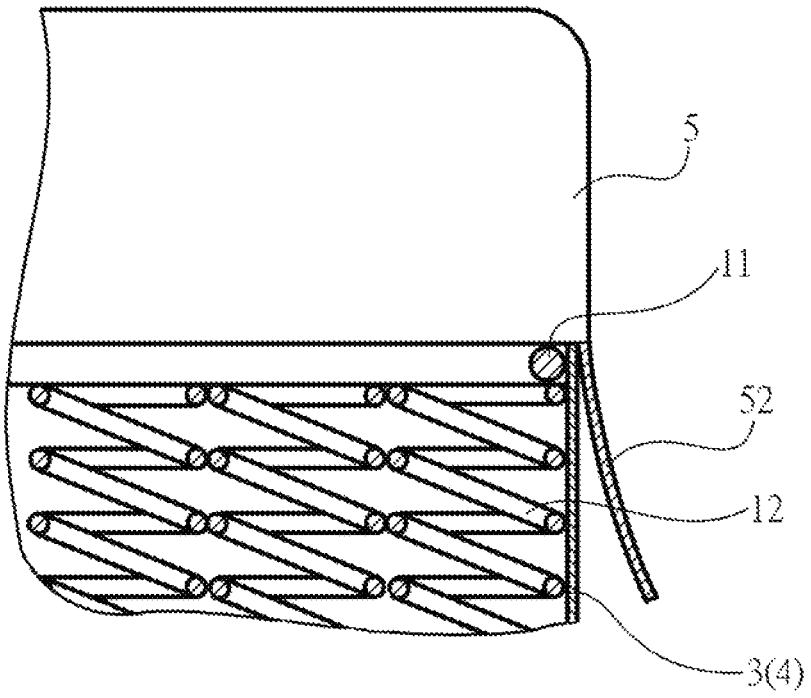
FIG. 4 is a cross-sectional view of a pad body connecting element and shielding sheet of the present invention.

Referring to FIGS. 3 and 4, the pad body 5 of the present invention is configured with the connecting element 51 on the bottom periphery and the shielding sheet 52 on the upper edge thereof; the shielding sheet 52 is extended downward from the upper edge to a position lower than the connecting element 51. Whereby, upon assembly, the pad body 5 is connected to the two longitudinal side covers 3 and two transverse side covers 4 by engaging the connecting element 51 with the connecting elements 31, 41, and the shielding sheet 52 can just hang down to cover the connecting elements 31, 41, 51, so as to prevent the connecting elements 31, 41, 51 from being exposed out to cause harm to the user, and allow the assembled mattress to be more eye-appealing.

Figure 5:
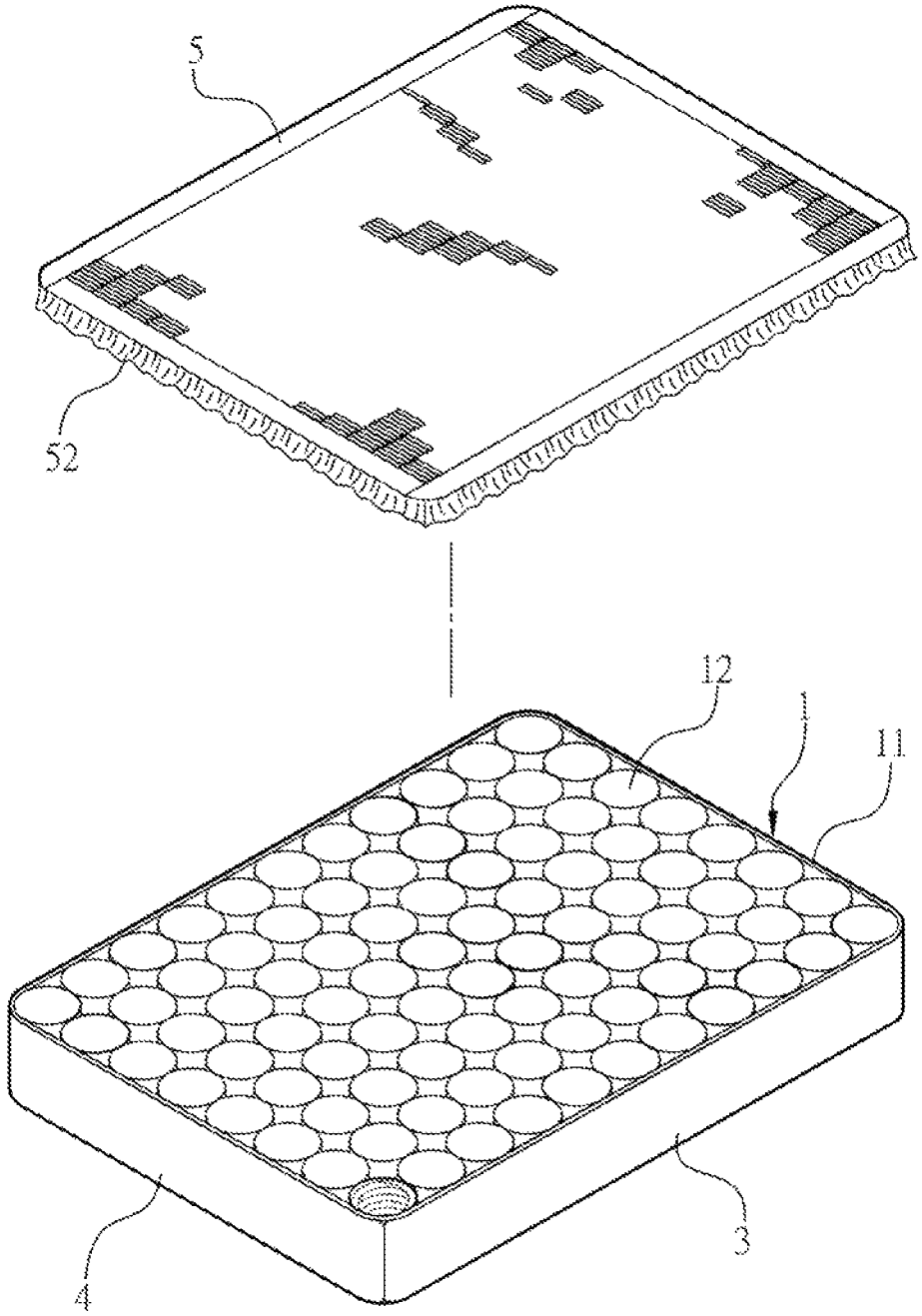
FIG. 5 is a perspective view of a pad body of the present invention in a replacement state.

Referring to FIGS. 1 and 5, when the user wants to change a different type of pad body 5, they first untie the connecting elements 31, 41, 51 to allow the two longitudinal side covers 3 and two transverse side covers 4 to be separated from the pad body 5, and then detach the original pad body 5 down to replace it with another needed pad body 5 (for example, replace the original cloth pad body 5 with a new pad body 5 such as a straw mat, latex or water bed, waterproof pad, or coconut fiber bed) without needing to discard the whole mattress, which can reduce economic burden and conform to environmental protection.

Since the pad body 5 is separable, an electric blanket can be placed under the pad bod 5 to achieve a warming effect when the temperature is low in winter, and the danger of burns and electric shock when sleeping directly on the electric blanket can be avoided due to the isolation of the pad body 5.

Figure 6:
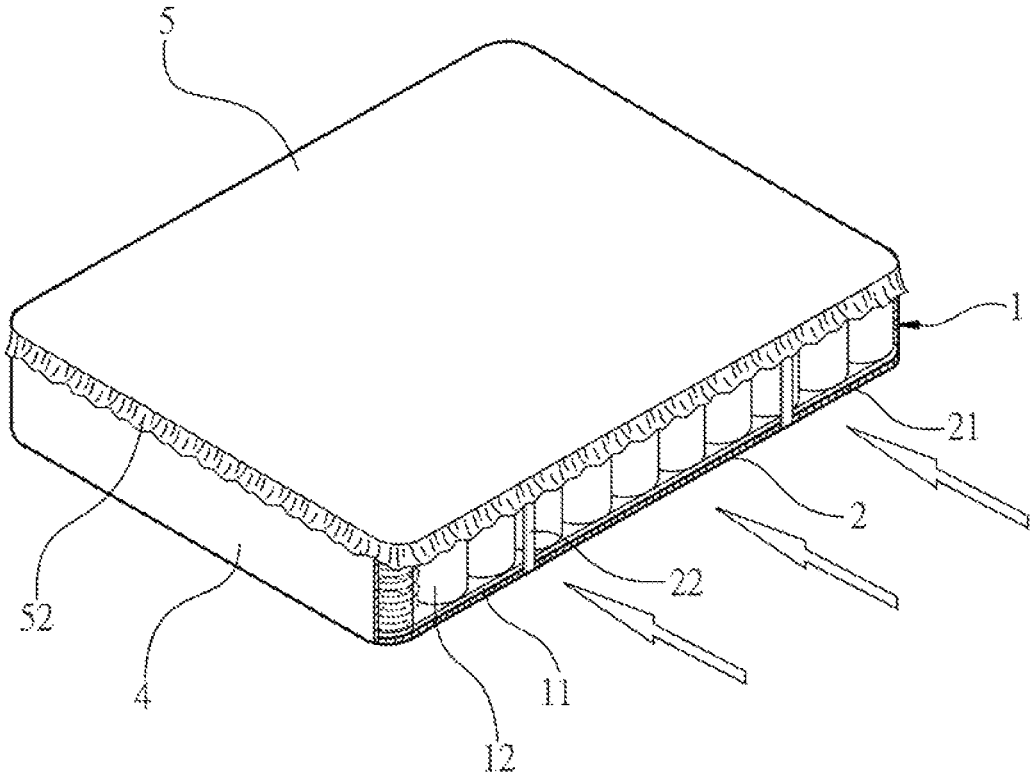
FIG. 6 is a perspective view of the present invention in an air permeability state.

Referring to FIG. 6, when the mattress of the present invention is in use, the two longitudinal side covers 3 or two transverse side covers 4 may be detached down when the temperature is high in summer to allow the cold air from air conditioner or fan to be filled in through the elastic body 1, thereby allowing the cool air to be filled under the pad body 5 to make the pad body 5 keep cool, and thus, make sleep more cozy. In the embodiment, the opposite two longitudinal side covers 3 are detached down to make the left and right sides of the mattress form a through state, thereby allowing the cool air from air conditioner or fan to blow in through the one side of the left and right sides and blow out through the other side, and allowing the cool air to fill under the pad body 5. In this way, it can be cooler when sleeping on the pad body 5, thereby improving the quality of sleep.

Figure 7:
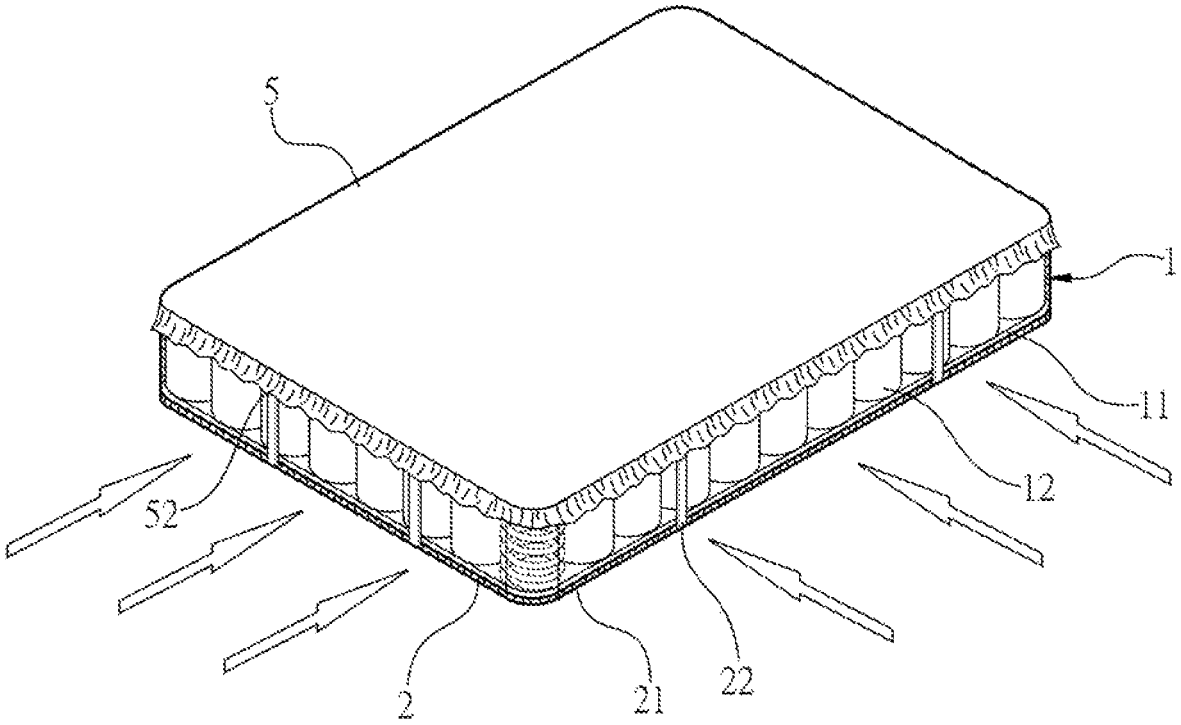
FIG. 7 is a perspective view of the present invention in another air permeability state.

Referring to FIGS. 1 and 7, when the mattress of the present invention is in use, the two longitudinal side covers 3 and two transverse side covers 4 may be detached down when the temperature is high in summer to allow the cool air from air conditioner or fan to be filled in through the elastic body 1, thereby allowing the cool air to be filled under the pad body 5 to make the pad body 5 keep cool, and thus, make sleep more cozy. In the embodiment, the opposite two longitudinal side covers 3 and opposite two transverse side covers 4 are detached down, and the hooks 23 of the first positioning elements 22 of the bottom cover are then pulled up to hook on the retaining rings of the second positioning elements 53 of the pad body 5 (in the embodiment of FIG. 1A, the first positioning elements and second positioning elements 53 are connected and buckled with each other through the Velcro tapes), allowing the pad body 5 and elastic body 1 to be kept in position to prevent displacement; since the hooks 23 are configured on the ends of the first positioning elements 22, the pad body 5 can be buckled tightly with the elastic body 1 to keep in position to prevent displacement after the hooks 23 are pulled up and hooked to the retaining rings of the second positioning elements 53. The front, rear, left, right sides of the mattress form a through state after the detachment, thereby allowing the cool air generated from air conditioner or fan to blow in through one of the four sides and blow out through the other sides. In this way, it is cooler when sleeping on the pad body 5, and further improves the quality of sleep.

Figure 8:
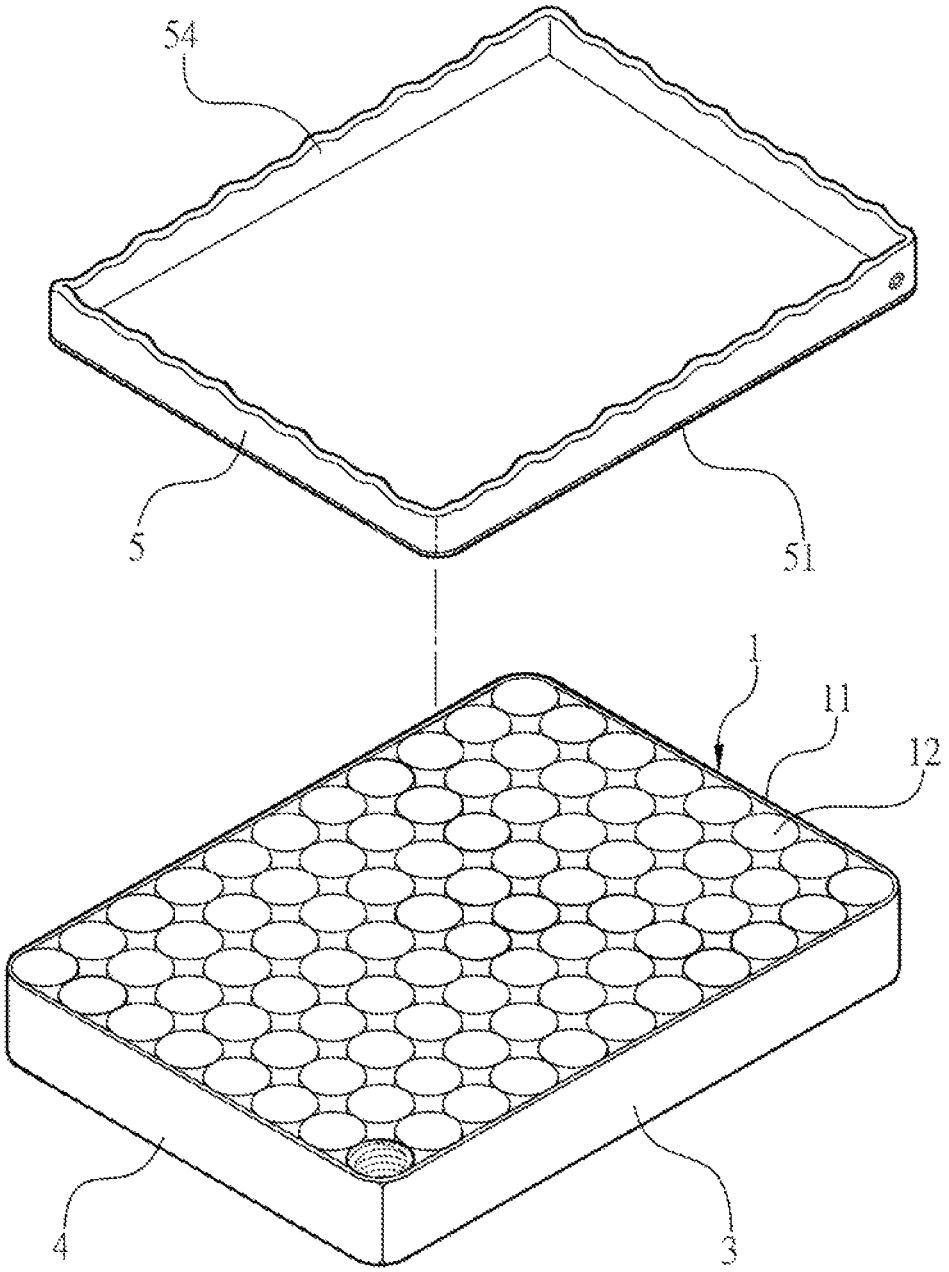
FIG. 8 is a perspective view of the pad body of the present invention in another replacement state.

Referring to FIGS. 1 and 8, the pad body 5 of the present invention may be an inflatable pad body; the edge of the pad body 5 is configured with a vertical protective wall 54, thereby preventing a young child or elderly from falling when lying down on the pad body 5.

The foregoing embodiments are merely illustrative of the preferred implementation of the present invention, rather than limiting the scope of the present invention. All minor modifications and changes will still not lose the essence of the present invention, nor deviate from the spirit of the present invention.

Conclusively, the present invention can assemble and disassemble the bottom cover, longitudinal side covers, transverse side covers, and pad body. With the elastic body that can be covered, a combination mattress is constituted. The mattress can be assembled and disassembled to form different ventilation effects in different directions when the temperature is high in summer, and different types of pad bodies can be replaced according to requirements to improve the practical value of the mattress.

I claim:

1. A combination mattress, comprising:

an elastic body, comprising a frame and a plurality of cylindrical coils side by side in an array configured inside said frame;

a bottom cover, being a sheet, and a periphery thereof configured with a connecting element;

two longitudinal side covers, each thereof being a sheet, and a periphery of each thereof configured with a connecting element;

two transverse side covers, each thereof being a sheet, and a periphery of each thereof configured with a connecting element; and a pad body, a bottom periphery thereof configured with a connecting element, and an upper edge thereof configured with a shielding sheet, upon assembly, said bottom cover, two longitudinal side covers and two transverse side covers connected together through said connecting elements to form a cover body for covering said elastic element, and said pad body placed on said elastic body; with said connecting elements being connected, and the assembly of a mattress is completed by connecting said connecting element of said pad body with said connecting elements of said two longitudinal side covers and two transverse side covers; whereby, when used, said detachable two longitudinal side covers and two transverse side covers are used to make said mattress have air permeability in different directions, and said detachable pad body allows the replacement thereof with a different type of pad body such as a straw mat, latex or water bed, waterproof pad, or coconut fiber bed, thereby improving the practical value of said mattress, wherein said bottom cover is provided with a plurality of first positioning elements arranged at intervals, and a bottom periphery of said pad body is provided with a plurality of second positioning elements respectively corresponding to said first positioning elements, wherein when at least one of the longitudinal side covers and the transverse side covers is detached down and separated from the bottom cover and the pad body, the first positioning elements and second positioning elements are selectively combinable with each other so as to have the bottom cover directly connected to the bottom periphery of the pad body to define an opening therebetween in communication with an interior of the elastic body.

2. The mattress according to claim 1, wherein said connecting elements configured on said bottom cover, two longitudinal side covers, two transverse side covers and pad body are zippers or Velcro tapes.

3. The mattress according to claim 1, wherein said first positioning element is a flexible belt, an end thereof is configured with a hook, and said second positioning element is a retaining ring corresponding to said hook.

4. The mattress according to claim 1, wherein said first positioning element and second positioning element are corresponding Velcro tapes.

5. The mattress according to claim 1, wherein said shielding sheet configured on said upper edge of said pad body is extended downward from said upper edge to a position lower than said connecting element, thereby shielding said connecting element.

* * * * *